US010066647B2

(12) United States Patent
Garcia

(10) Patent No.: US 10,066,647 B2
(45) Date of Patent: Sep. 4, 2018

(54) HYDRAULIC VALVE WITH ELECTROPNEUMATIC ACTUATOR

(71) Applicant: Adriano Nunes Garcia, Caxias do Sul (BR)

(72) Inventor: Adriano Nunes Garcia, Caxias do Sul (BR)

( * ) Notice: Subject to any disclaimer, the term of this patent is extended or adjusted under 35 U.S.C. 154(b) by 684 days.

(21) Appl. No.: 14/285,685

(22) Filed: May 23, 2014

(65) Prior Publication Data

US 2015/0337872 A1 Nov. 26, 2015

(51) Int. Cl.
*F15B 13/043* (2006.01)
*F15B 13/08* (2006.01)

(52) U.S. Cl.
CPC ..... *F15B 13/0839* (2013.01); *F15B 13/0871* (2013.01); *F15B 13/0431* (2013.01); *Y10T 137/86614* (2015.04)

(58) Field of Classification Search
CPC ..... F15B 13/0839; F15B 13/0871; F15B 13/0431; F15B 15/088; Y10T 137/86614; Y10T 137/8663; Y10T 137/87885; Y10T 137/87209; Y10T 137/87225; Y10T 137/86582; Y10T 137/8659; Y10T 137/86598; Y10T 137/86606; Y10T 137/86622
USPC .... 137/596.16, 596.18, 625.64, 625.66, 884, 137/625.6–625.63, 625.65; 91/51
See application file for complete search history.

(56) References Cited

U.S. PATENT DOCUMENTS 2,955,617 A * 10/1960 Collins ..... F16K 31/426 137/625.64
3,425,449 A * 2/1969 Leibfritz ..... F16K 31/426 137/625.64
3,434,390 A * 3/1969 Weiss ..... F15B 13/0436 137/625.61
3,859,791 A * 1/1975 Allen ..... F15B 11/02 137/625.62
3,927,603 A * 12/1975 Bernhoft ..... E02F 3/42 137/596.13
3,939,870 A * 2/1976 Guigliano ..... F15B 13/0402 137/624.27
4,428,400 A * 1/1984 Tantardini ..... F15B 13/043 137/596.13
5,018,431 A * 5/1991 Gray ..... F15B 13/043 137/596.17

(Continued)

*Primary Examiner* — Craig J Price
(74) *Attorney, Agent, or Firm* — Carter, DeLuca, Farrell & Schmidt, LLP

(57) ABSTRACT

A hydraulic valve with electropneumatic activation includes an air inlet that receives pressurized air from an air compressor and directs it into a line of the cylinder. The line is connected to an extension line attached to a solenoid extension valve that allows or blocks the passage of pressurized air from the extension line to a rear line. The rear line is attached to the rear chamber of the cylinder and connected to a retraction line attached to a solenoid retraction valve that allows or blocks the passage of pressurized air from the retraction line to an anterior line, which is attached to the front chamber of the cylinder. Thus, the passage of pressurized air is managed according to the desired movement of the stem of the hydraulic actuator. The pneumatic tubes are eliminated and electropneumatic valves are replaced by solenoid valves incorporated into the cylinder of the hydraulic valve.

12 Claims, 11 Drawing Sheets

(56) References Cited

U.S. PATENT DOCUMENTS 5,056,561 A * 10/1991 Byers ..... F15B 11/05
137/596.13
5,437,306 A * 8/1995 Asou ..... F15B 13/0821
137/625.64
5,558,126 A * 9/1996 Hayashi ..... F15B 13/043
137/269
5,588,465 A * 12/1996 Witowski ..... F15B 13/0402
137/596.16
5,597,015 A * 1/1997 Asou ..... F15B 13/043
137/625.64
5,632,306 A * 5/1997 Taka ..... F15B 13/0402
137/596.16
5,944,056 A * 8/1999 Miyazoe ..... F16K 27/003
137/625.64
5,983,921 A * 11/1999 Miyazoe ..... F15B 13/0402
137/269
5,996,629 A * 12/1999 Sato ..... F15B 13/0817
137/382
6,109,298 A * 8/2000 Kaneko ..... F15B 13/0817
137/551
6,164,335 A * 12/2000 Hayashi ..... F15B 13/0817
137/269
7,677,264 B2 * 3/2010 Miyazoe ..... F16K 31/426
137/269
7,735,518 B2 * 6/2010 Williams ..... F15B 13/0402
137/596.15
7,980,269 B2 * 7/2011 Fry ..... B61D 7/28
105/286
8,651,140 B2 * 2/2014 Bogdanowicz ..... F15B 13/0814
137/269
9,140,274 B2 * 9/2015 Liukkunen ..... F16K 11/0716

* cited by examiner

HYDRAULIC VALVE WITH ELECTROPNEUMATIC ACTUATOR

This patent is for a hydraulic valve with an electropneumatic actuator, responsible for directing the flow of hydraulic fluid to at least one working element, such as a hydraulic actuator. This descriptive report is compiled based on a model where the hydraulic valve is applied to move at least one hydraulic actuator responsible for tilting a truck bed. However, the hydraulic valve with electropneumatic actuator proposed here can be applied in other situations where the flow of hydraulic fluid needs to be directed to at least one working element.

One of the main means of transporting cargo is by road. One type of vehicle used for this transport is trucks with at least one tiltbed trailer. In order to optimize cargo transport, many of the trucks used are b-trains, allowing two trailers to be used per vehicle.

These trailers typically exhibit a tilting movement in order to unload the material transported; this movement is driven by a hydraulic actuator, more precisely by means extending or retracting its stem. Movement of the hydraulic actuator's stem is controlled by a hydraulic valve. The hydraulic valve can either have a unibody or stacked design. In the first configuration, the inlet, working and outlet sections are comprised in a single body. In the stacked valve, the input, working and outlet sections are individual components that are consecutively stacked.

As is common knowledge, a hydraulic valve directs the flow of hydraulic fluid to a hydraulic actuator through the vertical movement of a spool. In hydraulic valves with electropneumatic actuators, the spool's position is changed by the varying volume of the pressurized air inside the chambers of the cylinder, which is attached to the body of the hydraulic valve.

According to prior art, the pressurized air comes from an air compressor and moves to electropneumatic valves, which are connected chambers of the cylinder by pneumatic tubes. The electropneumatic valves manage the passage of air to the respective cylinder chamber, according to the desired movement in the stem of the hydraulic actuator.

A hydraulic valve with electropneumatic actuator presents two problems. For example, the electropneumatic valves and the pneumatic tubes that connect them to the chambers require a significant amount of time to be installed. In addition, the pneumatic tubes used are sturdy and require a considerable amount of space to be accommodated. They also offer a risk of leaks at connection points or possible breakage.

In order to eliminate these problems, the present invention proposes a hydraulic valve with electropneumatic actuator, consisting of an air inlet that receives pressurized air from an air compressor and directs it into a line of the cylinder, which is connected to an extension line attached to a solenoid extension valve that allows or blocks the passage of pressurized air from the extension line to a rear line; this rear line is attached to the rear chamber of the cylinder and the cylinder line is connected to a retraction line attached to a solenoid retraction valve that allows or blocks the passage of pressurized air from the retraction line to an anterior line; the anterior line is attached to the front chamber of the cylinder.

Thus, according to the proposed solution, the passage of pressurized air into the respective chamber of the cylinder can be managed according to the desired movement of the stem of the hydraulic actuator. Beneficially, in comparison to prior art, the pneumatic tubes have been eliminated and electropneumatic valves have been replaced by solenoid valves incorporated into the cylinder of the hydraulic valve. Thus, all the problems associated with the pneumatic tubes are also eliminated. In other words, the invention provides a hydraulic valve with electropneumatic actuator that occupies less space, can be mounted more quickly and uses fewer parts, thereby requiring less component inventory management and, consequently, less supplier management. Moreover, since there are no pneumatic tubes, the possibility of pressurized air leakage is reduced.

The invention can be better understood through the detailed description provided below, which is best interpreted using the following figures.

Figure 1:
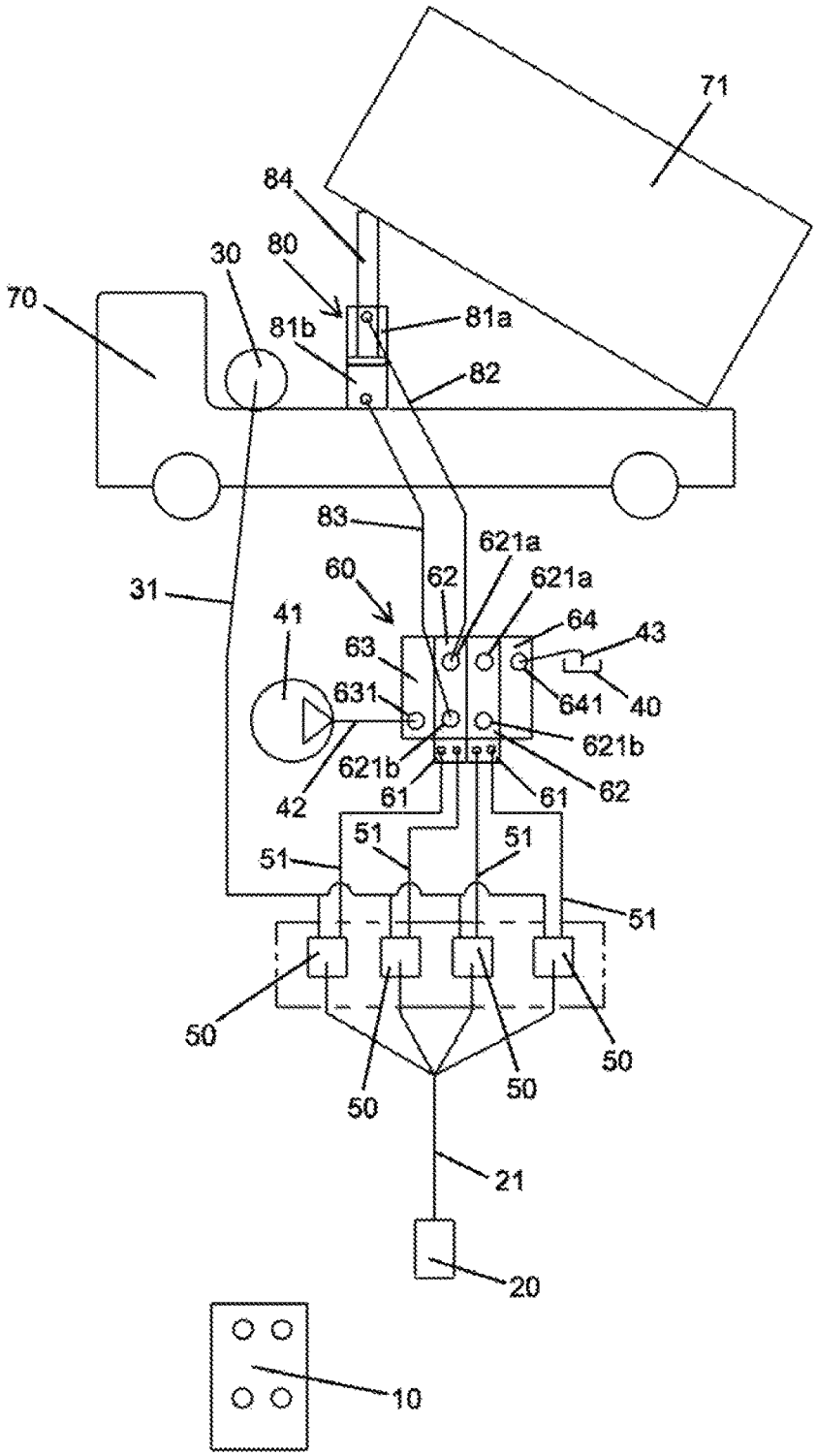
Fig. 1 PRIOR ART
FIG. 1 is a schematic diagram of the application of a conventional hydraulic valve (60) in moving the trailer (71) of a truck (70).
Figure 2:
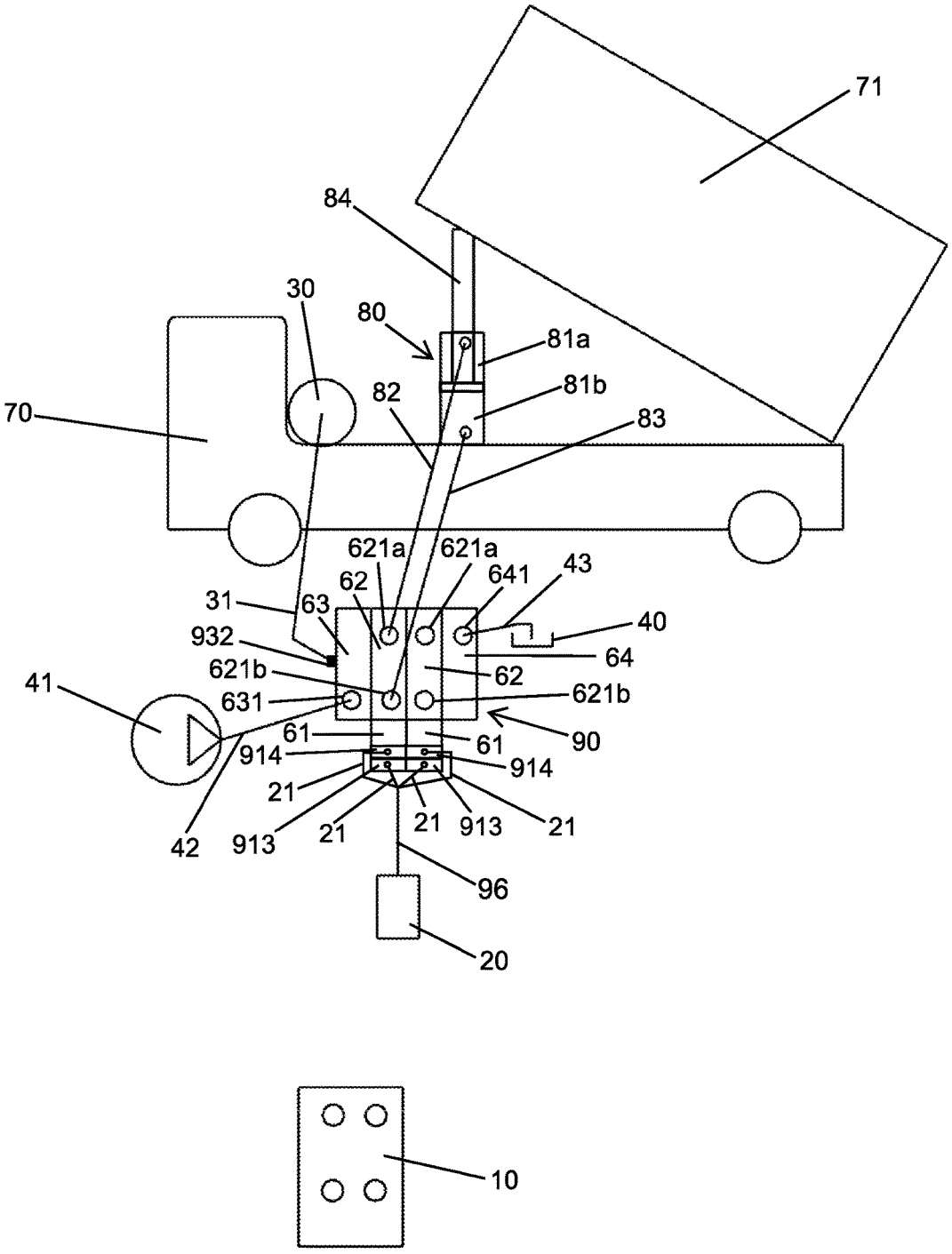
FIG. 2 is a schematic diagram of the application of a hydraulic valve (90), according to the invention, in moving the trailer (71) of a truck (70).
Figure 3:
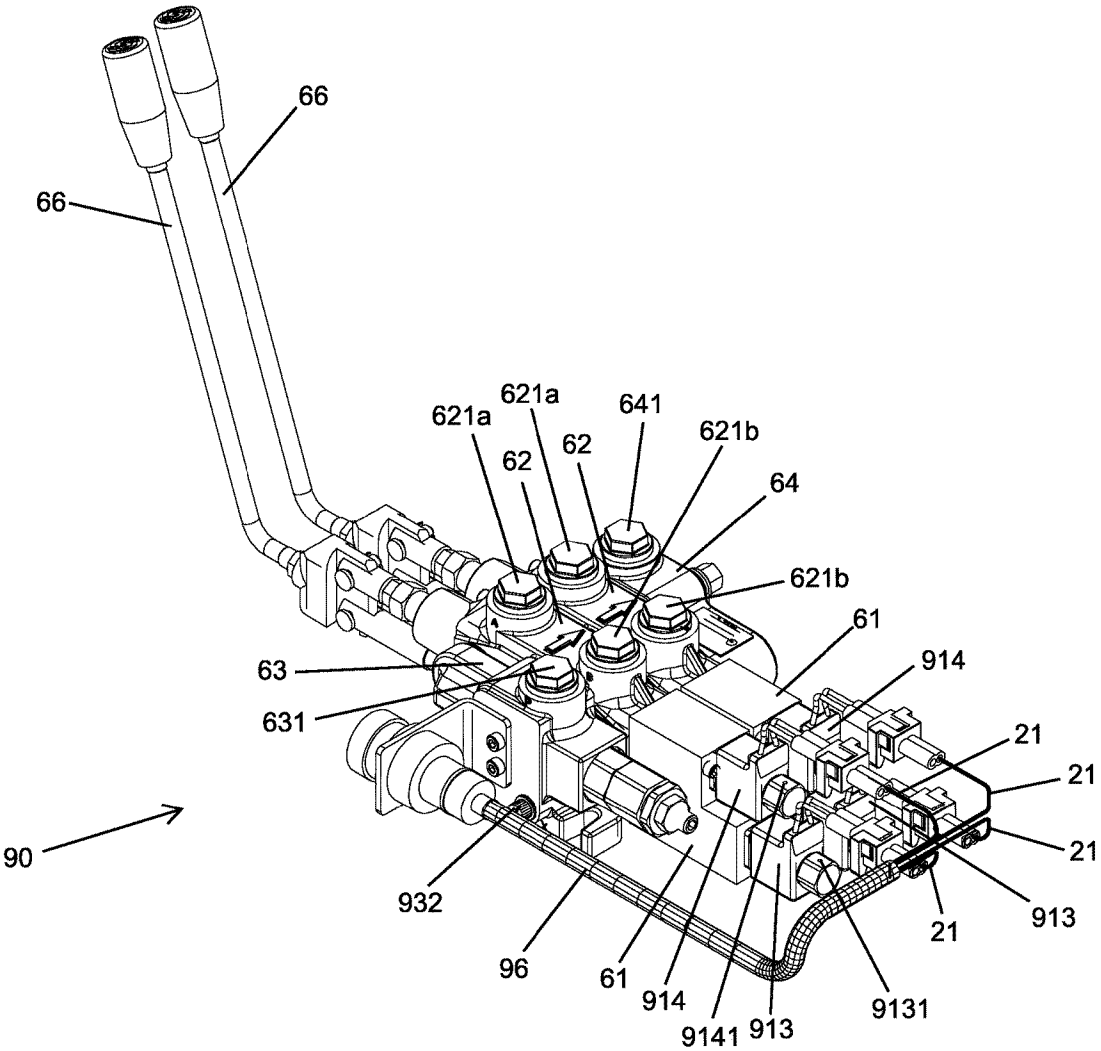
FIG. 3 is an exploded view of a hydraulic valve (90), in neutral, highlighting the inlet section (63).
Figure 4:
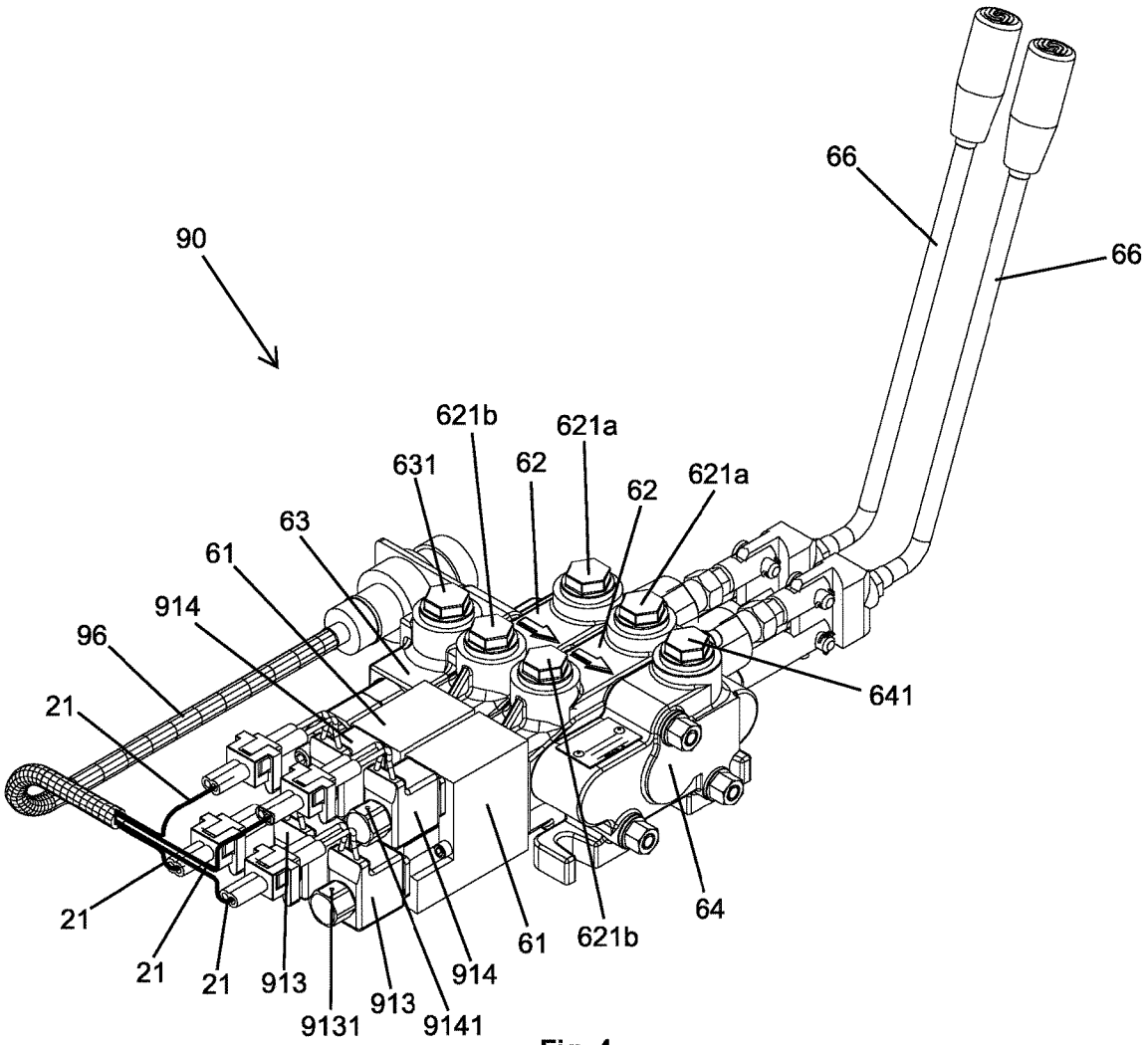
FIG. 4 is an exploded view of a hydraulic valve (90), in neutral, highlighting the outlet section (64).
Figure 5:
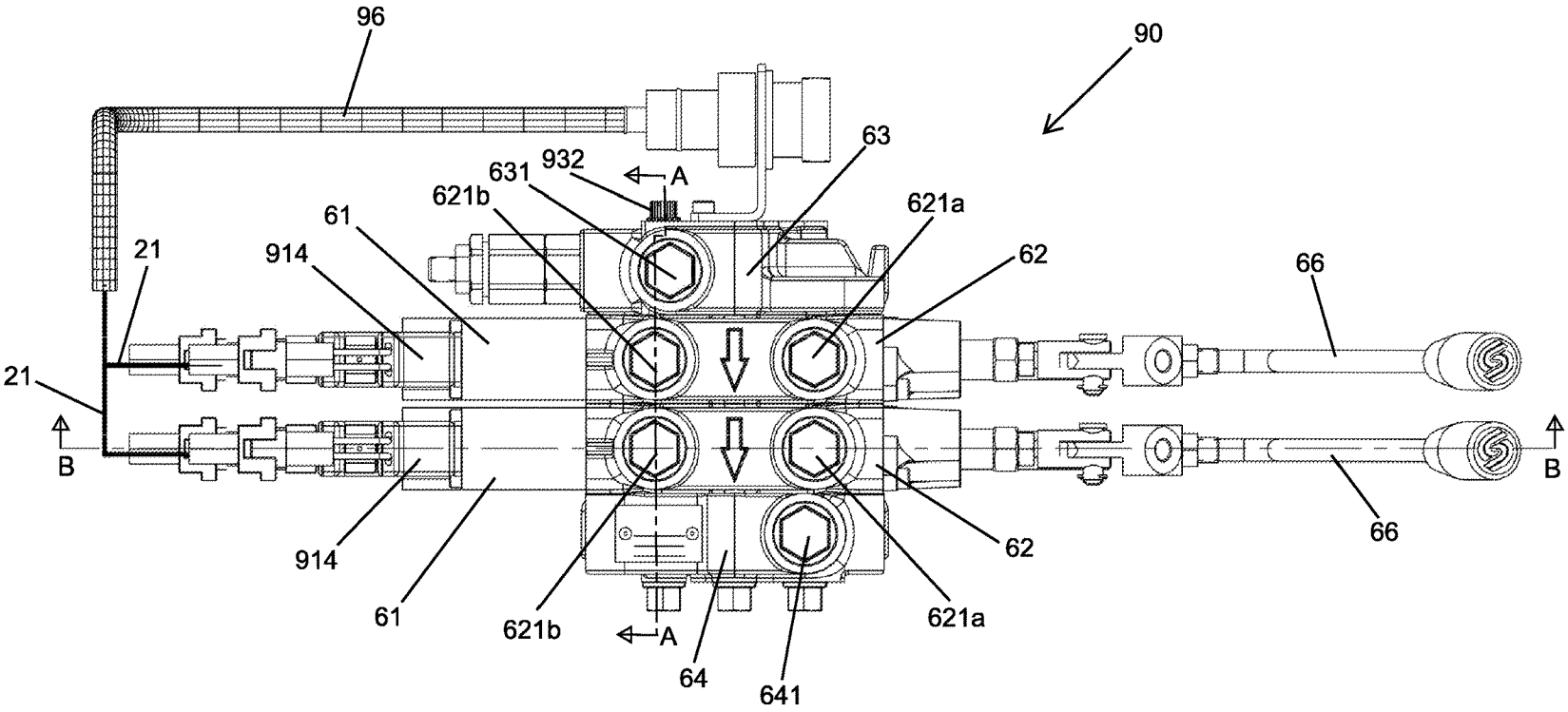
FIG. 5 is a top view of the hydraulic valve (90), in neutral, showing the A-A and B-B cross-sections.

According to the state-of-the-art, the tilting movement of the trailer (71) of a truck (70) is controlled by a hydraulic actuator (80), more precisely by means extending or retracting its stem (84). Movement of the hydraulic actuator's stem (84) is controlled by a conventional hydraulic valve (60) with electropneumatic activation. FIG. 1 is a schematic diagram of a conventional hydraulic valve (60) installed on a truck (70).

A conventional hydraulic valve (60) directs the flow of hydraulic fluid to a hydraulic actuator (80) by the vertical movement of a spool. In hydraulic valves with electropneumatic actuators (60), the spool's position is changed by the varying volume of the pressurized air inside the chambers of a cylinder (61), which is attached to the body of the conventional hydraulic valve (60).

According to prior art, pressurized air comes from an air compressor (30) and passes through a compressor tube (31) to the electropneumatic valves (50), which are connected to the cylinder chambers (61) by pneumatic tubes (51). The electropneumatic valves (50) manage the passage of air to the respective cylinder chamber (61), according to the desired movement in the stem (84) of the hydraulic actuator (80).

In the illustrated example, activation of the electropneumatic valves (50) is controlled by a remote control (10) attached to a receiver (20). In the remote control (10) the valves are arranged according to the movement to be executed by the hydraulic actuator (80). The receiver (20) is connected to the electropneumatic valves (50) by means of wiring (21).

The conventional hydraulic valve (60) is equipped with a working section (62) for each hydraulic actuator (80) present in the system, where the working section (62) is equipped with at least one opening (621*a*, 621*b*) for each hydraulic actuator (80).

With respect to the movement of the trailer (71), the hydraulic actuator (80) is equipped with both an upper (81*a*) and lower chamber (81*b*). The upper opening (621*a*) of each working section (62) is connected to the upper chamber (81*a*) of the respective hydraulic actuator (80) via a hose (82), and the lower opening (621*b*) of each working section (62) is connected to the lower chamber (81*b*) of the respective hydraulic actuator (80) via a hose (83). The conventional hydraulic valve (60) depicted in FIG. 1 has two working sections (62). One of these working sections (62) is inoperative and can be connected to another hydraulic actuator (80), not depicted, to move a second trailer (71) in the case of b-train truck (70), which has two trailers.

The conventional hydraulic valve (60) also has a working section (63) consisting of an inlet opening (631) through which hydraulic fluid enters from a hydraulic pump (41) attached to a tank (40), as well as an outlet section (64) consisting of an outlet opening (641) through which hydraulic fluid exits the conventional hydraulic valve (60) into the tank (40).

The hydraulic pump (41) exerts pressure on the hydraulic fluid such that it is continuously moves into the conventional hydraulic valve (60) through the inlet opening (631) of the inlet section (63) and removed through the outlet opening (641) of the outlet section (64), returning to the tank. The hydraulic pump (41) is connected to the conventional hydraulic valve (60) by a hydraulic hose (42) and the conventional hydraulic valve (60) is connected to the tank (40) by another hydraulic hose (43).

In order for the conventional hydraulic valve to operate (60) the receiver (20) interprets the signal sent by the remote control (10) and opens the respective electropneumatic valve (50) responsible for the desired action, clearing the passage for pressurized air from the air compressor (30). This allows the pressurized air to move through the respective pneumatic tube (51) to the respective chamber inside the cylinder (61). Thus, the spool of the conventional hydraulic valve (60) moves vertically, allowing hydraulic fluid to move into the hydraulic actuator (80) and, consequently, carrying out the movement requested by the remote control (10), either raising or lowering the trailer (71) of the truck (70).

The present invention proposes a hydraulic valve (90) with electropneumatic actuator equipped with an inlet section (63), consisting of an entry opening (631) that receives hydraulic fluid from a hydraulic pump (41) attached to a tank (40) and directing the hydraulic fluid into a main line (623).

The hydraulic valve (90) is also equipped with at least one working section (62), where each working section (62) consists of the main line (623) connected to at least one secondary line (624*a*, 624*b*); the secondary line is connected to at least one opening (621*a*, 621*b*), which is attached to at least one return line (625*a*, 625*b*); these connections are managed by a spool (65) that moves vertically to allow or block the passage of hydraulic fluid from the secondary line (624*a*, 624*b*) to the opening (621*a*, 621*b*) and the passage of the hydraulic fluid from the opening (621*a*, 621*b*) to the return line (625*a*, 625*b*); the opening (621*a*, 621*b*) is connected to one of the chambers (81*a*, 81*b*) of a hydraulic actuator (80), and one of the ends of the spool (65) is attached to a piston (616) inside the cylinder (61); the piston (616) divides the cylinder (61) into a front chamber (611) and rear chamber (612).

The hydraulic valve (90) is also equipped with an outlet section (64) that receives hydraulic fluid from the main line (623) and the return line (625*a*, 625*b*) and directs this fluid through an outlet opening (641) connected to the tank (40).

According to the invention, the hydraulic valve (90) consists of an air inlet (932) that receives pressurized air from an air compressor (30) and directs the pressurized air into a line (917) of the cylinder. This line (917) is connected to an extension line (9171) attached to a solenoid extension valve (913) that allows or blocks the passage of pressurized air from the extension line (9171) to a rear line (9174), which is connected the rear chamber (612) and the cylinder line (917) connected to a retraction line (9172) attached to a solenoid retraction valve (914) that allows or blocks the passage of pressurized air from the retraction line (9172) to an anterior line (9173), which is attached to the front chamber (611).

This makes it possible to manage the passage of pressurized air into the respective chamber (611, 612) of the cylinder (61) according to the desired movement of the stem (84) of the hydraulic actuator (80). Beneficially, the pneumatic tubes (51) have been eliminated and electropneumatic valves (50) have been replaced by solenoid valves (913, 914) incorporated into the cylinder (61) of the hydraulic valve (90). Thus, all the problems associated with the pneumatic tubes are also eliminated. In other words, the invention provides a hydraulic valve with electropneumatic actuator that occupies less space, can be mounted more quickly and uses fewer parts, thereby requiring less component inventory management and, consequently, less supplier management. Moreover, since there are no pneumatic tubes (51), the possibility of pressurized air leakage is reduced.

Preferentially, the pressurized air is directed from the air inlet (932) to the cylinder line (917) through a main line (926) attached to the cylinder line (917). Preferentially, the air inlet (932) is in the inlet section (63) and the main line (926) is in the inlet (63) and working sections (62), with the main line (926) connected to the cylinder line (917) via a secondary line (927).

Alternatively, according to a representation not depicted, the air inlet (932) and the main line (926) are present in the cylinder (61), with the main line (926) directly connected to the cylinder line (917).

Figure 7:
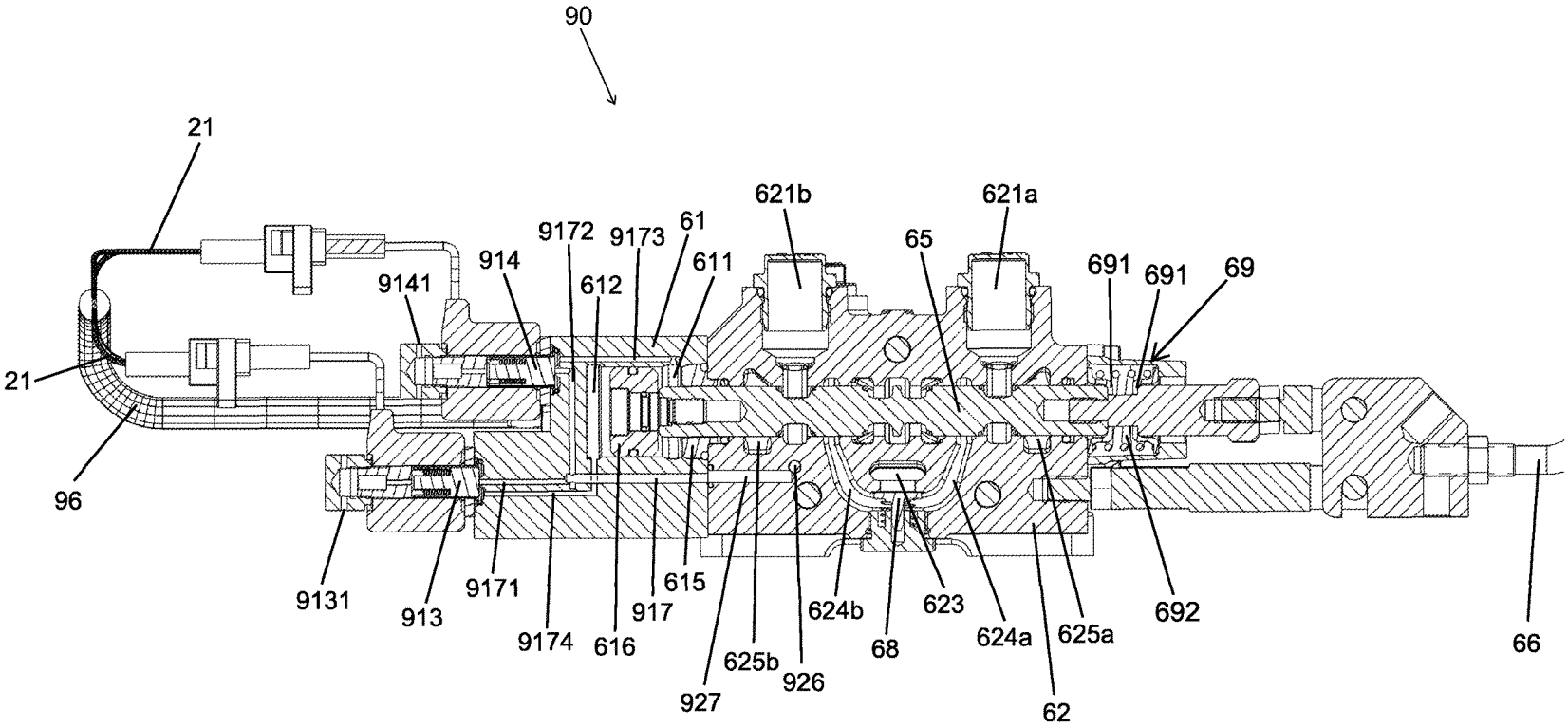
FIG. 7 shows the B-B cross-section depicted in FIG. 5.
Figure 8:
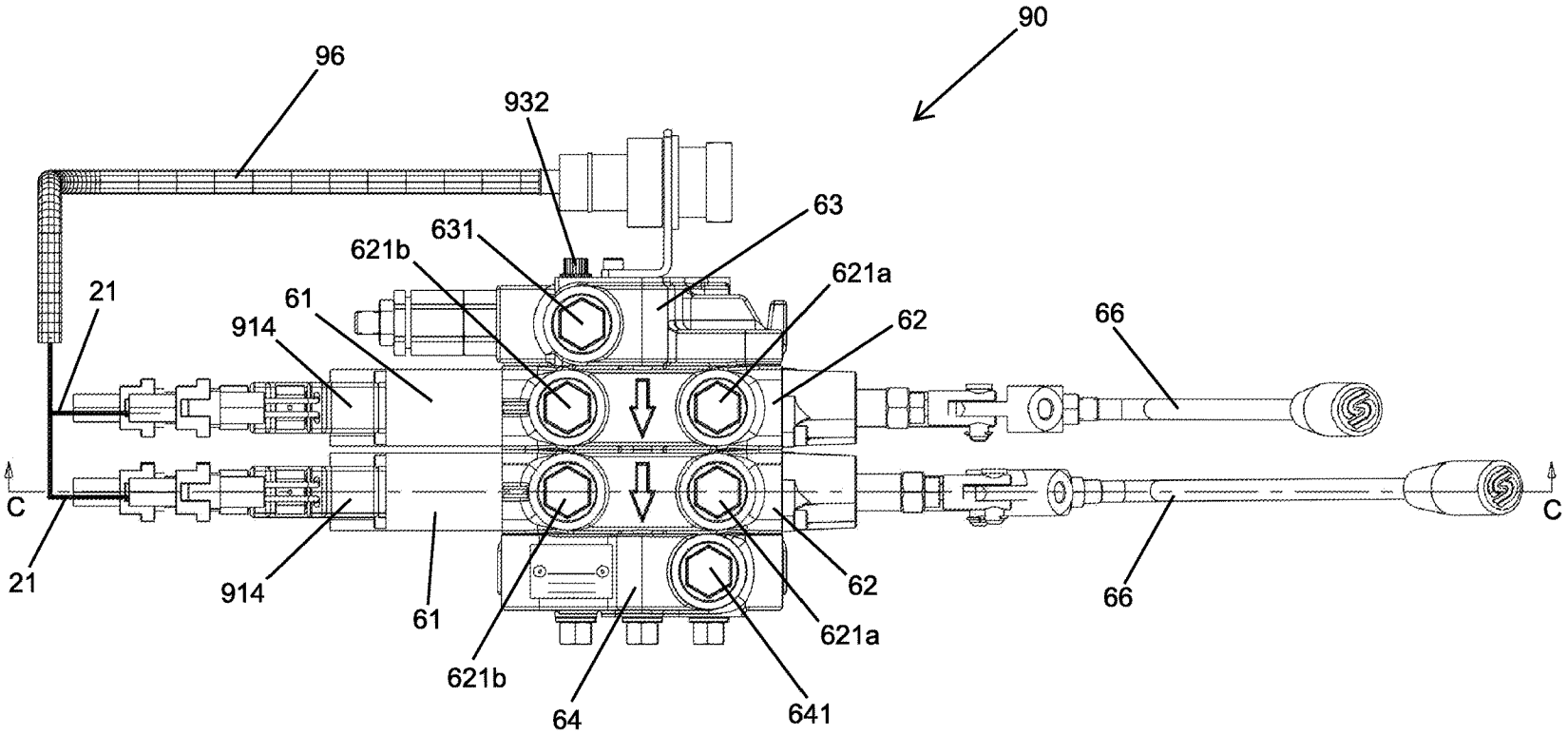
FIG. 8 is a top view of the hydraulic valve (90) in a raised position, showing the C-C cross-section.
Figure 9:
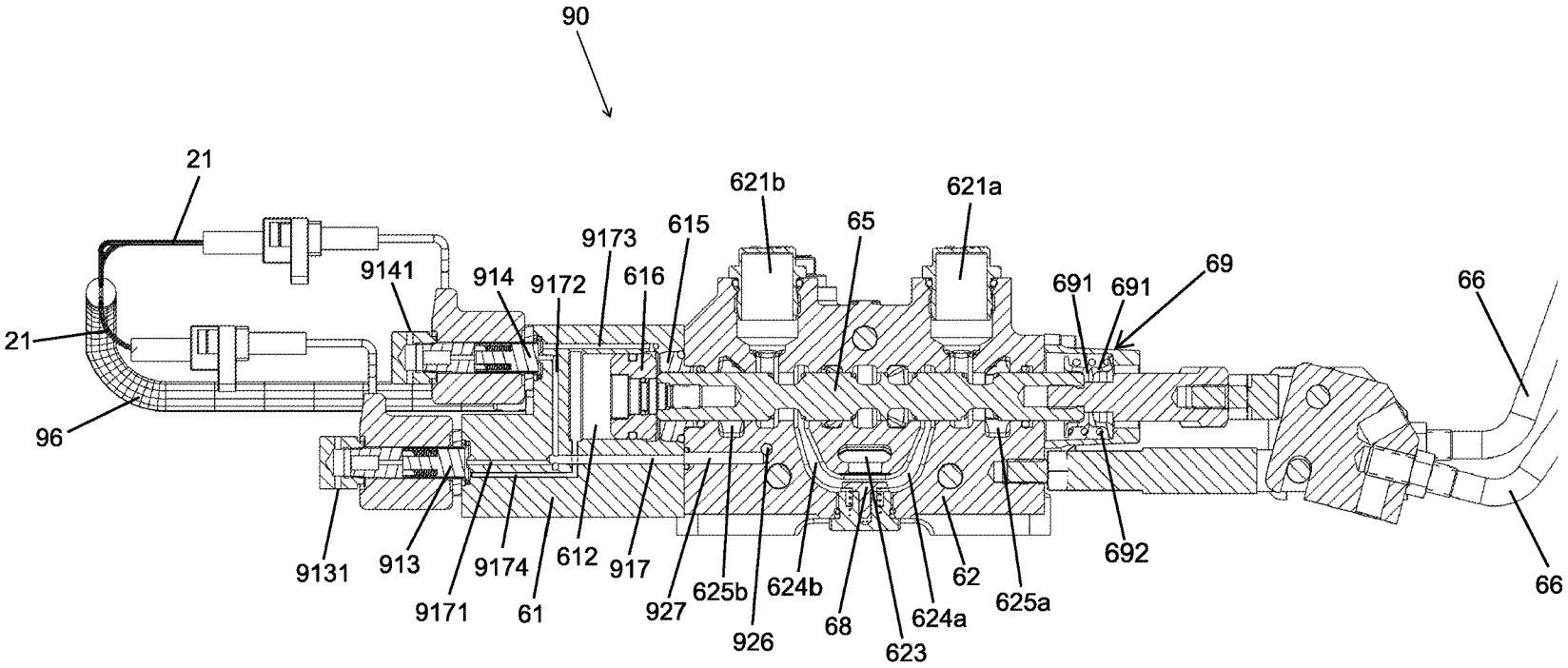
FIG. 9 shows the C-C cross-section depicted in FIG. 8.
Figure 10:
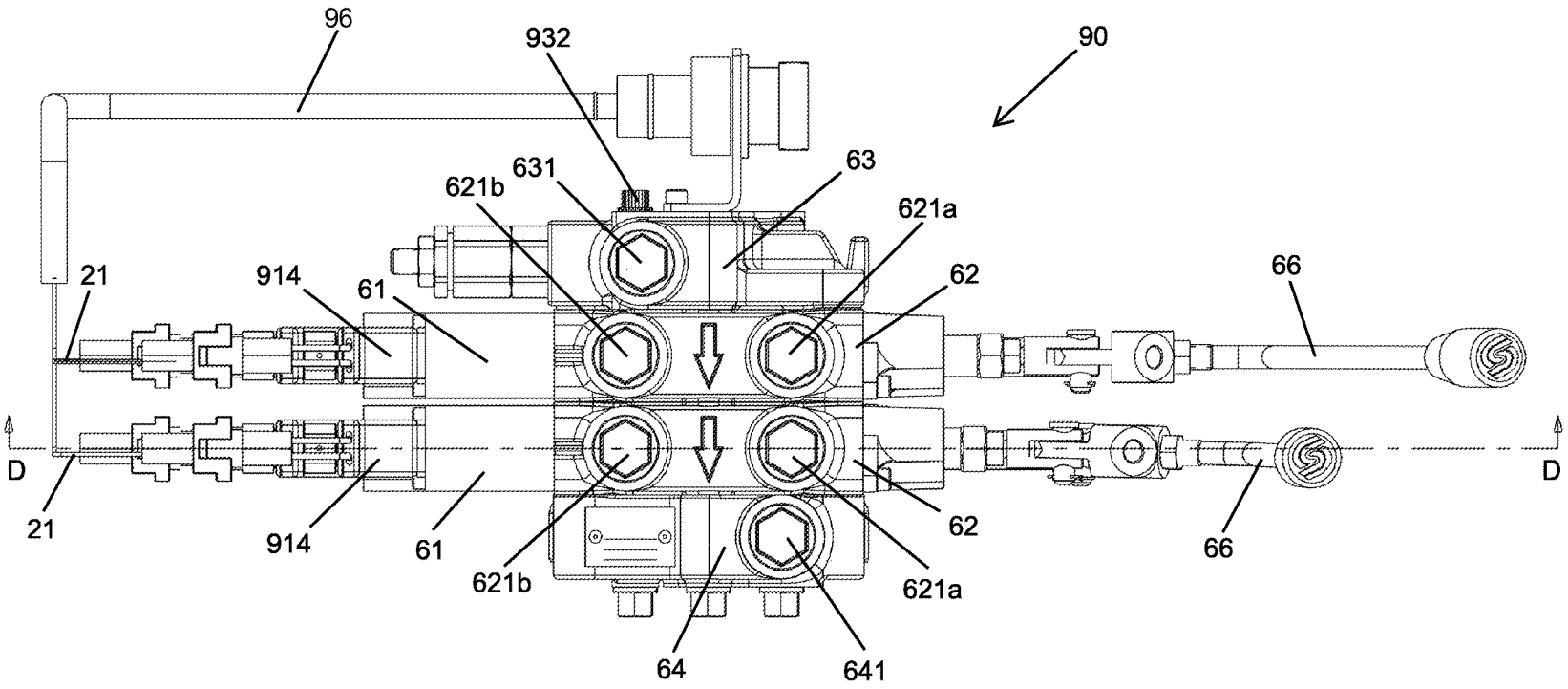
FIG. 10 is a top view of the hydraulic valve (90) in a lowered position, showing the D-D cross-section.
Figure 11:
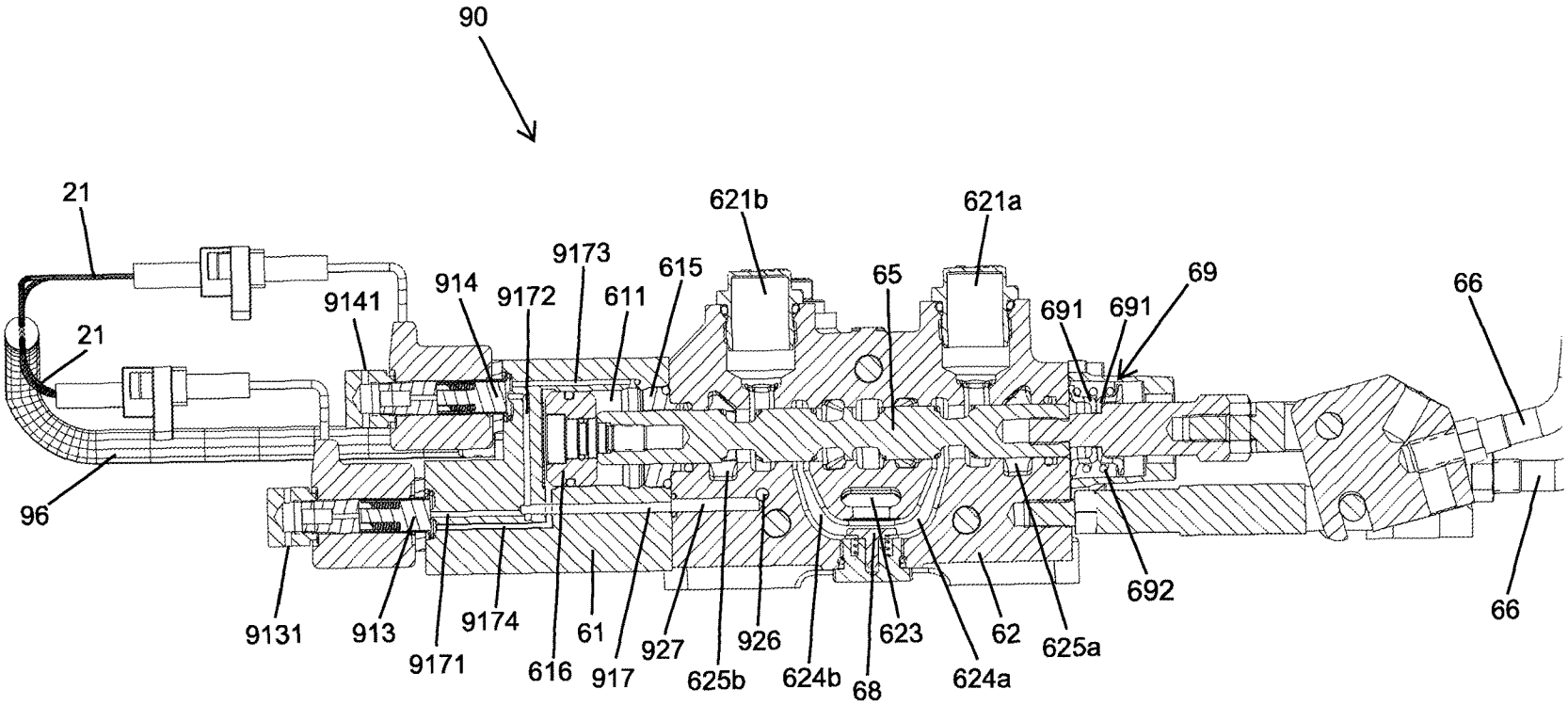
FIG. 11 shows the D-D cross-section depicted in FIG. 10.

In the incorporation depicted, as shown in FIGS. 7, 9 and 11, the rear line (9174) connecting the solenoid extension valve (913) to the rear chamber (612) is illustrated schematically. In practice, the rear line (9174) is not within the same cross-section as the cylinder line (917), as shown in FIGS. 7, 9 and 11. Thus, it becomes evident that there is no direct connection between the cylinder line (917) and rear line (9174). In order for the pressurized air to move from the cylinder line (917) to the rear line (9174), the pressurized air must pass through the solenoid extension valve (913).

In the incorporations depicted, the hydraulic valve is a stacked valve, that is, the inlet (63), working (62) and outlet (64) sections are individual components that are consecutively stacked. However, the hydraulic valve (90) proposed in the present invention may also have a unibody design, that is, the inlet (63), working (62) and outlet (64) sections are comprised into a single body.

Figure 6:
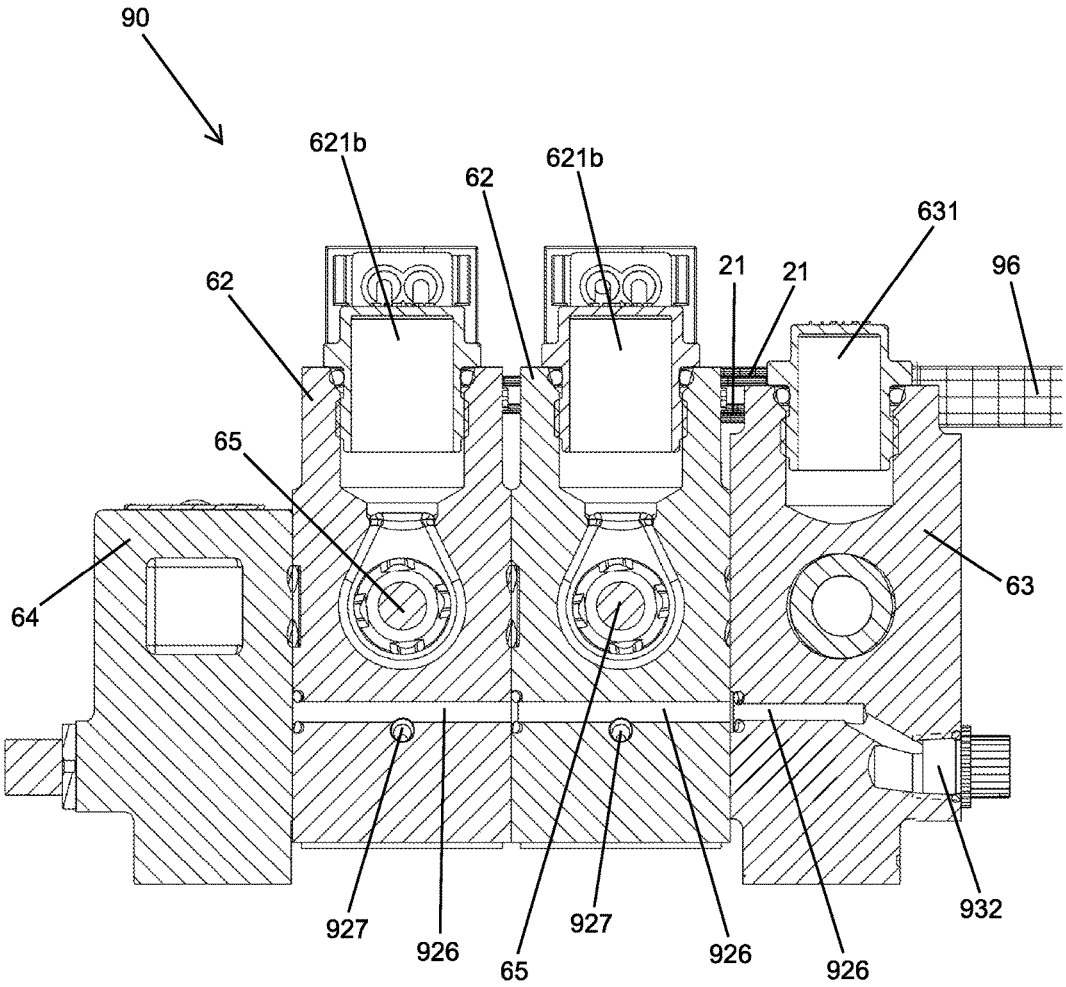
FIG. 6 shows the A-A cross-section depicted in FIG. 5.

The main line (926) consists of a hole through the body of the inlet section (63) and each working section (62). The assembly of the inlet section (63) next to the working section (62) and of the working sections (62) among themselves is such that their main lines (926) are concentrically aligned, as shown in FIG. 6. This ensures that the pressurized air from the inlet section (63) is available for all the working sections (62). The secondary line (927) of each working section (62) crosses over the main line (926), directing the pressurized air that flows along the main line (926) to the cylinder (61).

The hydraulic actuator (80) is positioned vertically and used to tilt the trailer (71) of a truck (70). According to an incorporation not depicted, the hydraulic valve (90) has at least one lower opening (621*b*), which is attached to the lower chamber (81*b*) of the hydraulic actuator (80). To extend the stem (84) of the hydraulic actuator (80), the hydraulic fluid is forced, through activation of the hydraulic valve (90) proposed here, from the tank (40) into the lower chamber (81*b*). Retraction of the stem (84) of the hydraulic actuator (80) occurs due to the weight of the trailer (71), with the hydraulic fluid forced from the lower chamber (81*b*) into the tank (40).

According to the incorporation depicted, as shown in FIGS. 2 to 7, the hydraulic valve (90) has a lower opening (621*b*), which is attached to the lower chamber (81*b*) of the hydraulic actuator (80) and an upper opening (621*a*) attached to the upper chamber (81*a*) of the hydraulic actuator (80). To extend the stem (84) of the hydraulic actuator (80), the hydraulic fluid is forced, through activation of the hydraulic valve (90) proposed here, from the tank (40) into the lower chamber (81*b*) and, consequently, the fluid that was in the upper chamber (81*a*) is forced into the tank (40). To retract the stem (84) of the hydraulic actuator (80), the hydraulic fluid is forced, through activation of the hydraulic valve (90) proposed here, from the tank (40) into the upper chamber (81*a*) and, consequently, the fluid that was in the lower chamber (81*b*) is forced into the tank (40). To that end, the hydraulic valve (90) consists of a lower secondary line (624*b*) and an upper secondary line (624*a*), as well as a lower return line (625*b*) and an upper return line (625*a*). Beneficially, according to the incorporation depicted, the stem (84) of the hydraulic actuator (80) retracts more quickly compared to retraction due to the weight of the trailer (71).

According to an incorporation not depicted, the hydraulic valve (90) can be equipped with a single working section (62) for supplying hydraulic fluid to a single hydraulic actuator (80), such as that used to tilt the trailer (71) of a truck (70). According to the incorporation depicted, as shown in FIGS. 2 to 7, the hydraulic valve (90) is equipped with two working sections (62) to supply hydraulic fluid to a respective hydraulic actuator (80). For example, one of the hydraulic actuators (80) can be used to tilt a trailer (71) and the other to tilt a second trailer (71), not depicted, as with a b-train truck (70), which has two trailers. Notable, the hydraulic valve (90) can be equipped with two additional working sections (62) to supply hydraulic fluid to the respective working elements, depending on the needs of the application.

Additionally, each working section (62) can be equipped with a check valve (68) positioned long the route from the main line (623) to the secondary line (624*a*, 624*b*). In working conditions, the check valve (68) is opened by the flow of hydraulic fluid generated by the hydraulic pump (41), from the main line (623) to the secondary line (624*a*, 624*b*), allowing the fluid to pass through it. When the flow of hydraulic fluid in this direction ceases, the check valve (68) is closed by a spring, halting the flow of the hydraulic fluid from the secondary line (624*a*, 624*b*) to the main line (623). Therefore, beneficially, should the hydraulic pump (41) malfunction or turn off accidentally, the check valve (68) is closed, preventing the hydraulic fluid from the hydraulic actuator (80) from returning to the tank (40) via the hydraulic pump.

Preferentially, a guide (615) is positioned on the side of each working section (62) facing the respective piston (616); the guide (615) is surrounded by the walls of the cylinder (61) and consisting of a hole through which the spool (65) moves vertically. The guide (615) is responsible for ensuring alignment between each cylinder and the respective working section (62), preventing any locking in the vertical movement of the spool (65) and piston (616).

Circulation of the hydraulic fluid from the hydraulic pump (41) to the inlet opening (631) of the inlet section (63) is achieved by a hydraulic hose (42) and circulation of the hydraulic fluid from the outlet opening (641) of the outlet section (64) to the tank (40) is achieved by a hydraulic hose (43). This forms a closed circuit, with constant circulation of hydraulic fluid, which leaves the tank (40) driven by the hydraulic pump (41), supplying the main line (623) of each working section (62) and returns to the tank (40).

Circulation of the hydraulic fluid between the upper opening (621*a*) of each working section (62) and the upper chamber (81*a*) of the respective hydraulic actuator (80) is achieved via a hose of the actuator (82), and circulation of the hydraulic fluid between the lower opening (621*b*) of each working section (62) and the lower chamber (81*b*) of the respective hydraulic actuator (80) is achieved via a hose of the actuator (83).

Circulation of compressed air from the air compressor (30) to the air inlet (932) is achieved through a compressor tube (31).

Each solenoid valve (913, 914) is connected by an electric wire (21) to a means of activation. The wires (21) can be grouped together into a wiring harness (96). Preferentially, the means of activating the solenoid valves (913, 914) is a receiver (20) associated with a remote control (10). Alternatively, the means of activating the solenoid valves (913, 914) is a set of electric buttons.

Each solenoid extension valve (913) is equipped with an escape (9131) and each solenoid retraction valve (914) also has an escape (9141). Whereas a solenoid extension valve (913) is deactivated, the respective rear chamber (612) is in contact with the atmosphere through the rear line (9174) and escape (9131) of the solenoid extension valve (913). While a solenoid retraction valve (914) is deactivated, the respective front chamber (611) is in contact with the atmosphere through the anterior line (9173) and escape (9141) of the solenoid retraction valve (914).

Additionally, at least one lever (66) can be attached to the other end of the spool (65) of each working section (62) to enable the vertical movement of the spool (65) through manual operation. Thus, the lever (66) is an alternative for operating the hydraulic valve (90) in relation to operation with the aid of an electropneumatic system.

When the hydraulic valve (90) is not activated, that is, in neutral, as shown in FIG. 7, the spool (65) of each working section (62) is in an intermediate position, blocking the passage of hydraulic fluid from the secondary lines (624*a*, 624*b*) to the openings (621*a*, 621*b*) and from the openings (621*a*, 621*b*) to the return lines (625*a*, 625*b*). Thus, there is no flow of hydraulic fluid in the hydraulic actuator (80) so as to maintain its stem (84) immobile. Consequently, the trailer (71) of the truck (70) is also immobile.

The spool (65) of each working section (62) is maintained in an intermediate position through the action of a centering assembly (69) at the end of the spool (65) facing the piston (616). The centering assembly (69) consists of two flow limiters (691) mounted facing each other between a spring (692). In neutral, as shown in FIG. 7, the spring (692) keeps the flow limiters (691) apart, thereby maintain the spool (65) in an intermediate position. Since the piston (616) is attached to the spool (65), in neutral, the piston (616) is also in an intermediate position is relation to the ends of the cylinder (61).

Furthermore, in neutral, the solenoid extension valve (913) of each cylinder (61) is closed, blocking the flow of pressurized air from the extension line (9171) to the rear line (9174), thereby blocking the passage of pressurized air into the rear chamber and the solenoid retraction valve (914) of each cylinder (61) is closed, blocking the flow of pressurized air from the retraction line (9172) to the anterior line (9173), thereby blocking the passage of pressurized air into the front chamber (611).

With the trailer (71) in a horizontal position, the stem of the hydraulic actuator (80) is retracted. In order to raise the trailer (71) by extending the stem (84) of the hydraulic actuator (80), an operator must activate the lifting command on the remote control (10), sending a signal to the receiver (20) and opening the solenoid extension valve (913) corresponding to the hydraulic actuator (80) that one wishes to move. By opening the solenoid extension valve (913), pressurized air passes from the extension line (9171) to the rear line (9174), allowing this air to move into the rear chamber (612). The entry of pressurized air into the rear chamber (612) moves the piston (616) linearly in order to reduce the volume of the front chamber (611), as shown in FIG. 9. Since the solenoid retraction valve (914) remains deactivated, the air contained in the front chamber (611) is released into the atmosphere through the anterior line (9173) and the escape (9141) of the solenoid retraction valve (914). Since the piston (616) is attached to the spool (65), this causes the spool (65) to move linearly in the same direction, allowing hydraulic fluid to pass from the secondary line (624*b*) to the lower opening (621*b*) and, therefore, the passage of hydraulic fluid into the lower chamber (81*b*) of the hydraulic actuator (80). The flow of the spool (65) and, therefore, the piston (616) is limited by the centering assembly (69), more precisely through the compression of the spring (692) and contact between one flow limiter (691) and the adjacent flow limiter (691).

The entry of hydraulic fluid into the lower chamber (81*b*) moves the stem (84), extending it and raising the trailer (71). This vertical movement of the spool (65) allows hydraulic fluid to pass from the upper opening (621*a*) to the upper return line (625*a*). Thus, the fluid that was in the upper chamber (81*a*) is forced into the upper return line (625*a*) and on to the tank (40).

Once the trailer (71) has been lifted, the lifting command on the remote control (10) can be deactivated, closing the solenoid extension valve (913). Once the solenoid extension valve is closed (913), the flow of pressurized air into the rear chamber (612) is interrupted. Consequently, the force exerted by the spring (692) becomes overwhelming, decompressing the spring (692), moving the spool (65) and, therefore, the piston (616), linearly into their intermediate positions. The return of the spool (65) to its intermediate position interrupts the flow of hydraulic fluid between the lower opening (621*b*) and lower secondary line (624*b*) and, therefore, the exit of hydraulic fluid from the lower chamber (81*b*) of the hydraulic actuator (80). Thus, the stem (84) is maintained in an extended position and the trailer (71) in a raised position.

With the trailer (71) in a raised position, the stem (84) of the hydraulic actuator (80) is extended. In order to lower the trailer (71) by retracting the stem (84) of the hydraulic actuator (80), an operator must activate the lowering command on the remote control (10), sending a signal to the receiver (20) and opening the solenoid retraction valve (914) corresponding to the hydraulic actuator (80) that one wishes to move. By opening the solenoid retraction valve (914), pressurized air passes from the retraction line (9172) to the anterior line (9173), allowing this air to move into the front chamber (611). The entry of pressurized air into the front chamber (611) moves the piston (616) linearly in order to reduce the volume of the rear chamber (612), as shown in FIG. 11. Since the solenoid extension valve (913) remains deactivated, the air contained in the rear chamber (612) is released into the atmosphere through the rear line (9174) and the escape (9131) of the solenoid extension valve (913). Since the piston (616) is attached to the spool (65), this causes the spool (65) to move linearly in the same direction, allowing hydraulic fluid to pass from the upper secondary line (624*a*) to the upper opening (621*a*) and, therefore, the passage of hydraulic fluid into the upper chamber (81*a*) of the hydraulic actuator (80). The flow of the spool (65) and, therefore, the piston (616) is limited by the centering assembly (69), more precisely through the compression of the spring (692) and contact between one flow limiter (691) and the adjacent flow limiter (691).

The entry of hydraulic fluid into the upper chamber (81*a*) moves the stem (84), retracting it and lowering the trailer (71). This vertical movement of the spool (65) allows hydraulic fluid to pass from the lower opening (621*b*) to the lower return line (625*b*). Thus, the fluid that was in the lower chamber (81*b*) is forced into the lower return line (625*b*) and on to the tank (40).

Once the trailer (71) has been lowered, the lowering command on the remote control (10) can be deactivated, closing the solenoid retraction valve (914). Once the solenoid retraction valve is closed (914), the flow of pressurized air into the front chamber (611) is interrupted. Consequently, the force exerted by the spring (692) becomes overwhelming, decompressing the spring (692), moving the spool (65) and, therefore, the piston (616), vertically into their intermediate positions. The return of the spool (65) to its intermediate position interrupts the flow of hydraulic fluid between the upper opening (621*a*) and upper secondary line (624*a*) and, therefore, the exit of hydraulic fluid from the upper chamber (81*a*) of the hydraulic actuator (80). Thus, the stem (84) is maintained in a retracted position and the trailer (71) in a lowered position.

The preferred or alternative incorporations described herein do not have the power to limit the present invention to structural forms; equivalent constructive variations are possible, though still within the scope of protection of the invention.

The invention claimed is:

1. A hydraulic valve, comprising:

an inlet section defining:

an entry opening configured to receive hydraulic fluid from a hydraulic pump; and an air inlet configured to receive pressurized air from an air source;

at least one working section of a plurality of working sections including:

a main body;

a main line coupled to the main body and configured to receive the hydraulic fluid from the entry opening;

at least one secondary line fluidly connected to the main line;

at least one opening fluidly attached to the at least one secondary line and configured to be connected to a chamber of an actuator;

at least one return line selectively connected to the at least one opening;

a spool extending through the main body and configured to move linearly within and relative to the main body in a longitudinal direction between a first position, in which the spool allows passage of the hydraulic fluid from the at least one secondary line to the at least one opening and from the at least one opening to the at least one return line, and a second position, in which the spool blocks passage of the hydraulic fluid from the at least one secondary line to the at least one opening and from the at least one opening to the at least one return line;

an air main line passing through the main body of each of the plurality of working sections in a transverse direction, the air main line configured to receive the pressurized air from the air inlet; and a plurality of cylinders, each cylinder of the plurality of cylinders coupled to a corresponding main body of the plurality of working sections, at least one cylinder of the plurality of cylinders including:

a piston disposed within a chamber defined in the at least one cylinder to divide the chamber into a front chamber and a rear chamber, wherein the piston is attached to a rear end portion of the spool;

a solenoid extension valve at least partially disposed within the at least one cylinder and in fluid communication with the rear chamber, the solenoid extension valve configured to open or close to respectively allow or block passage of the pressurized air;

a solenoid retraction valve at least partially disposed within the at least one cylinder and in fluid communication with the front chamber, the solenoid retraction valve configured to open or close to respectively allow or block passage of the pressurized air into the front chamber; and a cylinder line in fluid communication with the air main line, the cylinder line being fluidly connected to the solenoid extension valve and the solenoid retraction valve, wherein when the solenoid extension valve is in an open state, the pressurized air moves from the solenoid extension valve into the rear chamber to linearly move the spool toward the first position, whereby the hydraulic fluid passes from the at least one secondary line to the at least one opening and, in turn, into the chamber of the actuator to move the actuator in a first direction.

2. The hydraulic valve according to claim 1, wherein the solenoid extension valve of the at least one cylinder includes an escape.

3. The hydraulic valve according to claim 2, wherein the at least one cylinder further includes a rear line fluidly interconnecting the rear chamber and the solenoid extension valve, when the solenoid extension valve is deactivated, the rear chamber is in fluid communication with the atmosphere through the rear line and the escape.

4. The hydraulic valve according to claim 1, wherein the solenoid retraction valve of the at least one cylinder includes an escape.

5. The hydraulic valve according to claim 4, wherein the at least one cylinder further includes an anterior line fluidly interconnecting the front chamber and the solenoid retraction valve, when the solenoid retraction valve is deactivated, the front chamber is in fluid communication with the atmosphere through the anterior line and the escape.

6. The hydraulic valve according to claim 1, wherein each of the plurality of cylinders further includes:

an extension line configured to receive the pressurized air, the extension line being in fluid communication with the solenoid extension valve; and a rear line selectively fluidly connected to the extension line via the solenoid extension valve, the rear line being in fluid communication with the rear chamber.

7. The hydraulic valve according to claim 1, wherein the at least one working section includes a check valve fluidly coupling the main line and the at least one secondary line, the check valve being biased toward a closed position.

8. The hydraulic valve according to claim 1, wherein the at least one working section includes a centering assembly coupled to the spool and configured to maintain the spool in the second position.

9. The hydraulic valve according to claim 8, wherein when the solenoid retraction valve of the at least one cylinder is in an open state, the pressurized air moves into the front chamber to linearly move the spool toward a third position, in which the hydraulic fluid passes from another secondary line of the at least one working section to another opening in the at least one working section and, in turn, into another chamber of the actuator to move the actuator in a second direction.

10. The hydraulic valve according to claim 1, wherein the solenoid extension valve of the at least one cylinder is disposed rearwardly of the rear chamber.

11. The hydraulic valve according to claim 1, wherein the main body of the at least one working section defines a longitudinal axis, the solenoid extension valve and the solenoid retraction valve being disposed on opposite sides of the longitudinal axis.

12. The hydraulic valve according to claim 1, wherein the solenoid retraction valve of the at least one cylinder is disposed above the solenoid extension valve.

* * * * *